US006196873B1

(12) United States Patent
Murakami et al.

(10) Patent No.: US 6,196,873 B1
(45) Date of Patent: Mar. 6, 2001

(54) WATERPROOF CONNECTOR

(75) Inventors: Takao Murakami; Masaru Fukuda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/327,454

(22) Filed: Jun. 8, 1999

(30) Foreign Application Priority Data

Jun. 10, 1998 (JP) ..... 10-162570

(51) Int. Cl.[7] ..... H01R 13/40
(52) U.S. Cl. ..... 439/595
(58) Field of Search ..... 439/595, 752, 439/275

(56) References Cited

U.S. PATENT DOCUMENTS

| | | |
|---|---|---|
| 3,879,239 | 4/1975 | Rager et al. . |
| 4,083,902 | 4/1978 | Clyde . |

(List continued on next page.)

FOREIGN PATENT DOCUMENTS

| | | |
|---|---|---|
| 0 299 797 | 1/1989 | (EP) . |
| 0 546 753 | 6/1993 | (EP) . |
| 0 631 344 | 12/1994 | (EP) . |
| 0 691 710 | 1/1996 | (EP) . |
| 0 700 125 | 3/1996 | (EP) . |
| 0 778 636 | 6/1997 | (EP) . |
| 2 415 375 | 1/1979 | (FR) . |
| 2 753 008 | 3/1998 | (FR) . |
| 2 168 548 | 6/1986 | (GB) . |
| 2 321 346 | 7/1998 | (GB) . |
| 2 321 792 | 8/1998 | (GB) . |
| 2 321 802 | 8/1998 | (GB) . |
| 50-54591 | 5/1975 | (JP) . |
| 61-12621 | 4/1986 | (JP) . |

(List continued on next page.)

*Primary Examiner*—Brian Sircus
*Assistant Examiner*—Thanh-Tam Le
(74) *Attorney, Agent, or Firm*—Finnegan, Henderson, Farabow, Garrett & Dunner, L.L.P.

(57) ABSTRACT

A waterproof connector includes: an inner housing being formed with a plurality of terminal housing chambers; an outer housing being fitted with the inner housing and being formed with a plurality of electric wire insertion through holes; and a spacer intervening between the inner housing and the outer housing which is formed with other electric wire insertion through holes at positions opposing to the electric wire insertion through holes of the outer housing, wherein the rubber taps are housed respectively in the rubber tap housing concave sections; wherein a thin film which blocks up the electric wire insertion through hole is formed integrally at a predetermined position. The thin film is provided so as to be capable of being broken, thereby all of the electric wire insertion through holes are interconnected so that the electric wires can be inserted through the respective electric wire insertion through holes. The rubber taps are held by the spacer so as not to slip out of the rubber tap housing concave sections, and the rubber taps seal the terminal housing chambers and the electric wires.

4 Claims, 6 Drawing Sheets

U.S. PATENT DOCUMENTS

| | | | | |
|---|---|---|---|---|
| 4,640,567 | * | 2/1987 | Lundergan et al. | 339/94 |
| 4,643,506 | | 2/1987 | Kobler . | |
| 4,662,629 | | 5/1987 | Plovie . | |
| 4,662,692 | * | 5/1987 | Uken et al. | 339/96 |
| 4,684,187 | | 8/1987 | Rudy, Jr. et al. . | |
| 4,708,662 | | 11/1987 | Klein . | |
| 4,713,021 | * | 12/1987 | Kobler | 439/272 |
| 4,776,813 | | 10/1988 | Wilson et al. . | |
| 4,944,688 | * | 7/1990 | Lundergan | 439/275 |
| 4,969,260 | | 11/1990 | Kondo et al. . | |
| 4,976,634 | | 12/1990 | Green et al. . | |
| 4,979,913 | | 12/1990 | Aiello et al. . | |
| 5,116,236 | * | 5/1992 | Colleran et al. | 439/271 |
| 5,120,269 | | 6/1992 | Endo et al. . | |
| 5,215,635 | | 6/1993 | Stein et al. . | |
| 5,240,431 | | 8/1993 | Yagi et al. . | |
| 5,266,045 | * | 11/1993 | Yamamoto et al. | 439/275 |
| 5,316,504 | | 5/1994 | Jinno . | |
| 5,419,722 | | 5/1995 | Onoda . | |
| 5,498,170 | | 3/1996 | Tanaka . | |
| 5,529,508 | | 6/1996 | Chiotis et al. . | |
| 5,562,477 | | 10/1996 | Moore et al. . | |
| 5,569,050 | | 10/1996 | Lloyd . | |
| 5,580,264 | | 12/1996 | Aoyama et al. . | |
| 5,613,868 | | 3/1997 | Ohsumi et al. . | |
| 5,645,451 | | 7/1997 | Ohsumi et al. . | |
| 5,707,251 | | 1/1998 | Sakai et al. . | |
| 5,709,563 | | 1/1998 | Saito . | |
| 5,730,627 | | 3/1998 | Okabe . | |
| 5,782,657 | | 7/1998 | Wolla et al. . | |
| 5,803,773 | | 9/1998 | Kashiyama et al. . | |
| 5,836,788 | | 11/1998 | Torii . | |
| 5,860,834 | | 1/1999 | Sugiyama . | |
| 5,931,699 | | 8/1999 | Saito . | |
| 5,931,707 | | 8/1999 | Ito . | |
| 5,947,774 | | 9/1999 | Abe . | |
| 5,984,737 | | 11/1999 | Nagano et al. . | |

FOREIGN PATENT DOCUMENTS

| | | |
|---|---|---|
| 62-188069 | 11/1987 | (JP) . |
| 64-63282 | 3/1989 | (JP) . |
| 4-49480 | 4/1992 | (JP) . |
| 4-101380 | 9/1992 | (JP) . |
| 5-152028 | 6/1993 | (JP) . |
| 6-151107 | 5/1994 | (JP) . |
| 7-22079 | 1/1995 | (JP) . |
| 7-122331 | 5/1995 | (JP) . |
| 07201395 | 8/1995 | (JP) . |
| 7-298450 | 11/1995 | (JP) . |
| 07326424 | 12/1995 | (JP) . |
| 8-250304 | 9/1996 | (JP) . |
| 1-63282 | 10/1996 | (JP) . |
| 9-73848 | 2/1997 | (JP) . |
| 09082394 | 3/1997 | (JP) . |
| 10-60096 | 3/1998 | (JP) . |
| 10-92478 | 4/1998 | (JP) . |
| 92/15133 | 9/1992 | (WO) . |
| WO 92 15133 | 9/1992 | (WO) . |
| 96/32760 | 10/1996 | (WO) . |
| WO 96 32760 | 10/1996 | (WO) . |
| 97/36346 | 10/1997 | (WO) . |
| WO 97 36346 | 10/1997 | (WO) . |

* cited by examiner

WATERPROOF CONNECTOR

BACKGROUND OF THE INVENTION

1. Field of the Invention

The present invention relates to a multiple waterproof connector which improves waterproofness between a connector housing and plural electric wires with which terminals are connected and does not require a dummy tap.

2. Description of Related Art

As such a dummy tap for this type of the waterproof connector, a dummy tap shown in FIGS. 1 and 2 is disclosed in Japanese Utility Model Application Laid-Open No. 62-188069, and a dummy tap shown in FIGS. 3 and 4 is disclosed in Japanese Patent Application Laid-Open No. 7-122331.

A dummy tap A for a waterproof connector shown in FIGS. 1 and 2 is composed of a pin 5 made of synthetic resin having a bar-shaped section 5*a* and disk-shaped step section 5*b*, and a circular rubber tap 6 into which the bar-shaped section 5*a* of the pin 5 is fitted. Moreover, a plurality of terminal housing holes 2 are formed in a connector housing 1 of a waterproof connector, and a female terminal 4 which is connected with an electric wire 3 is engaged with by a lance (flexible engagement arm) 1*a* so as to be housed in each terminal housing hole 2.

As shown in FIG. 2, the dummy tap A is fitted into a base end side of the free terminal housing hole 2 of the connector housing 1 of the waterproof connector so that water is prevented from penetrating the terminal housing hole 2 from the outside.

A dummy tap B for the waterproof connector shown in FIGS. 3 and 4 is composed of a rubber tap 7 for sealing an electric wire which is fitted into a free terminal housing hole 2 of plural terminal housing holes 2 formed in a connector housing 1' of a waterproof connector into which a female terminal is not mounted, and a rear holder 8 made of synthetic resin, which has a shaft section 8*a* whose diameter is equal to a diameter of an electric wire 3 and which is inserted into an electric wire insertion hole 7*a* of the rubber tap 7.

As shown in FIG. 4, when a frame-shaped lock section 8*b* of the rear holder 8 is engaged with the connector housing 1', the dummy tap B is fitted into the free terminal housing hole 2 of the connector housing 1' and is locked so that water is prevented from penetrating the terminal housing hole 2 from the outside.

The conventional connector housings 1 and 1' of the water proof connector have the plural terminal housing holes 2 respectively, but some terminal housing holes 2 are not used because of an improvement or disuse of an option circuit (namely, variations of a wire harness circuit is used in common). For this reason, the rear holder 8 of the dummy tap A or dummy tap B is indispensable, and thus a number of parts is increased and the cost becomes high.

In addition, since the variation of application or the like of the waterproof connectors is diversified, in the case where free terminal housing holes 2 of the connector housings 1 and 1' are changed to be used, parts should be replaced with another ones.

Furthermore, since in the case of the dummy tap A, the rubber tap 6 or the like is pressed into the terminal housing hole 2 so as to be fixed thereto, there is some fear that the dummy tap A slips out of the terminal housing hole 2 due to an influence of vibration or the like of the connector housing 1. Moreover, in the case of the dummy tap B, since the lock section 8*b* of the rear holder 8 is exposed from the connector housing 1', there is some fear that when the electric wire 3 is removed, the electric wire 3 gets caught on the lock section 8*b* and the rear holder 8 is removed. In these cases, the dummy taps A and B easily slip off and thus reliability of their waterproofness is deteriorated.

SUMMARY OF THE INVENTION

The present invention has been achieved with such points in view. It therefore is an object of the invention to provide a multiple waterproof connector which can obtain waterproofness of a rubber tap easily and securely without replacing parts with another ones even if a wiring path of an electric wire is changed in a connector housing, and can reduce a number of parts so as to reduce total cost.

A first aspect of the invention provides a waterproof connector, comprising: an inner housing being formed with a plurality of terminal housing chambers, the terminal housing chambers are to be inserted with a terminal which is connected with an electric wire; an outer housing being fitted with the inner housing, the outer housing being formed with a plurality of electric wire insertion through holes to be inserted with the electric wire at one wall section opposing to the terminal housing chambers, the outer housing further being formed with rubber tap housing concave sections at positions of the inside of the one wall section facing to the former electric wire insertion through holes, the rubber tap housing concave sections being to be inserted with rubber taps which are formed with other electric wire insertion through holes; and a spacer intervening between the inner housing and the outer housing, the spacer is formed with still other electric wire insertion through holes at positions opposing to the electric wire insertion through holes of the outer housing, wherein the inner housing, the outer housing and the spacer compose a connector housing; wherein the rubber taps are housed respectively in the rubber tap housing concave sections; wherein a thin film which blocks up the electric wire insertion through hole is formed integrally with a predetermined position of the outside of at least one electric wire insertion through hole of the plural electric wire insertion through holes of the outer housing, the thin film is provided so as to be capable of being broken through; wherein when the electric wire is going to be connected with the terminals housed in the terminal housing chambers formed in the inner housing, the thin film is broken through, thereby the electric wire insertion through hole formed in the spacer, the electric wire insertion through hole formed in the rubber tap and the electric wire insertion through hole formed in the outer housing are interconnected so that the electric wires can be inserted through the respective electric wire insertion through holes; and wherein the rubber taps are held by the spacer so as not to slip out of the rubber tap housing concave sections, and the rubber taps seal the terminal housing chambers and the electric wires.

Since the waterproof connector according to the first aspect does not require a dummy tap, a number of parts is reduced and the cost is lowered. Moreover, since the thin film, which is formed integrally with the outside of the electric wire insertion holes of the outer housing, prevents water from penetrating from the outside, even if the electric wire insertion hole is provided on the rubber tap, the waterproofness can be obtained easily and securely. Moreover, even if the wiring paths of the electric wires in the outer housing are changed, when the thin film which blocks up the outside of the electric wire insertion holes of the outer housing is broken through to be opened, the electric wires can be inserted therethrough easily without replacing parts, and thus the application or the like of the waterproof connector is diversified.

A second aspect of the invention provides a waterproof connector, comprising: an inner housing being formed with a plurality of terminal housing chambers, the terminal housing chambers are to be inserted with a terminal which is connected with an electric wire; an outer housing being fitted with the inner housing, the outer housing being formed with a plurality of electric wire insertion through holes to be inserted with the electric wire at one wall section opposing to the terminal housing chambers, the outer housing further being formed with rubber tap housing concave sections at positions of the inside of the one wall section facing to the former electric wire insertion through holes, the rubber tap housing concave sections being to be inserted with rubber taps which are formed with other electric wire insertion through holes; and a spacer intervening between the inner housing and the outer housing, the spacer is formed with still other electric wire insertion through holes at positions opposing to the electric wire insertion through holes of the outer housing, wherein the inner housing, the outer housing and the spacer compose a connector housing; wherein the rubber taps are housed respectively in the rubber tap housing concave sections; wherein the rubber taps are held by the spacer so as not to slip out of the rubber tap housing concave sections, and the rubber taps seal the terminal housing chambers and the electric wires; wherein one of the electric wire inserted through the electric wire insertion through hole through which the electric wire is to be inserted among the plural electric wire insertion through holes formed in the outer housing, is inserted through the electric wire insertion through hole formed in the rubber tap and the electric wire insertion through hole formed in the spacer so as to be connected with the terminal housed in the terminal housing chamber formed in the inner housing; wherein at least one of the electric wire insertion through hole through which the electric wire is not to be inserted among the plural electric wire insertion through holes formed in the spacer is provided with a pin-shaped shaft having an equivalent diameter to a diameter of the electric wire in such a manner that the shaft is projected from the electric wire insertion through hole; and wherein the shaft provided on the spacer is fitted into the electric wire insertion through hole of the rubber tap which is housed in the rubber tap housing concave section facing the electric wire insertion through hole of the spacer through which the electric wire is not to be inserted.

Since the waterproof connector according to the second aspect does not require a dummy tap, a number of parts is reduced and the cost is lowered. Moreover, since the electric wire insertion hole of the rubber tap where the electric wire is not wired is blocked up by the shaft of the spacer, the waterproofness of the rubber taps can be obtained easily and securely.

A third aspect of the invention provides a waterproof connector according to the second aspect wherein the shaft provided on the spacer is formed integrally at a position of the spacer where the electric wire insertion through hole is formed; and wherein when the electric wire is going to be inserted through the spacer, a base end of the shaft is cut so that an electric wire insertion through hole is formed in the spacer.

In the waterproof connector according to the third aspect, even if the wiring paths of the electric wires are changed, when the base end of the shaft of the spacer is cut, the electric wire insertion holes can be formed easily without replacing parts, and thus the application or the like of the waterproof connector is diversified.

A fourth aspect of the invention provides a waterproof connector according to the second aspect wherein the shaft provided on the spacer is capable of being fitted into and removed from the electric wire insertion through hole of the spacer.

In the waterproof connector according to the fourth aspect, the shaft which blocks up the electric wire insertion hole of the rubber tap where the electric wire is not wired is projected from the spacer easily, and even if the wiring paths of the electric wires in the connector housing are changed, the position of the shaft of the spacer can be changed easily.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
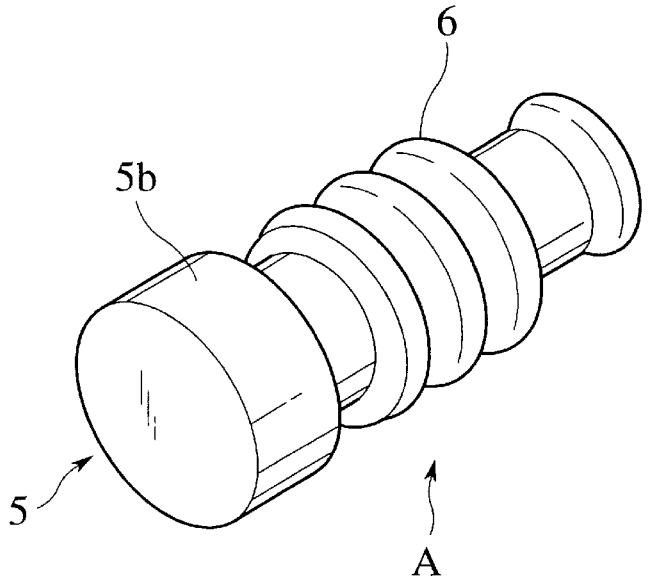
FIG.1 PRIOR ART
FIG. 1 is a perspective view of a conventional dummy tap for a waterproof connector.
Figure 2:
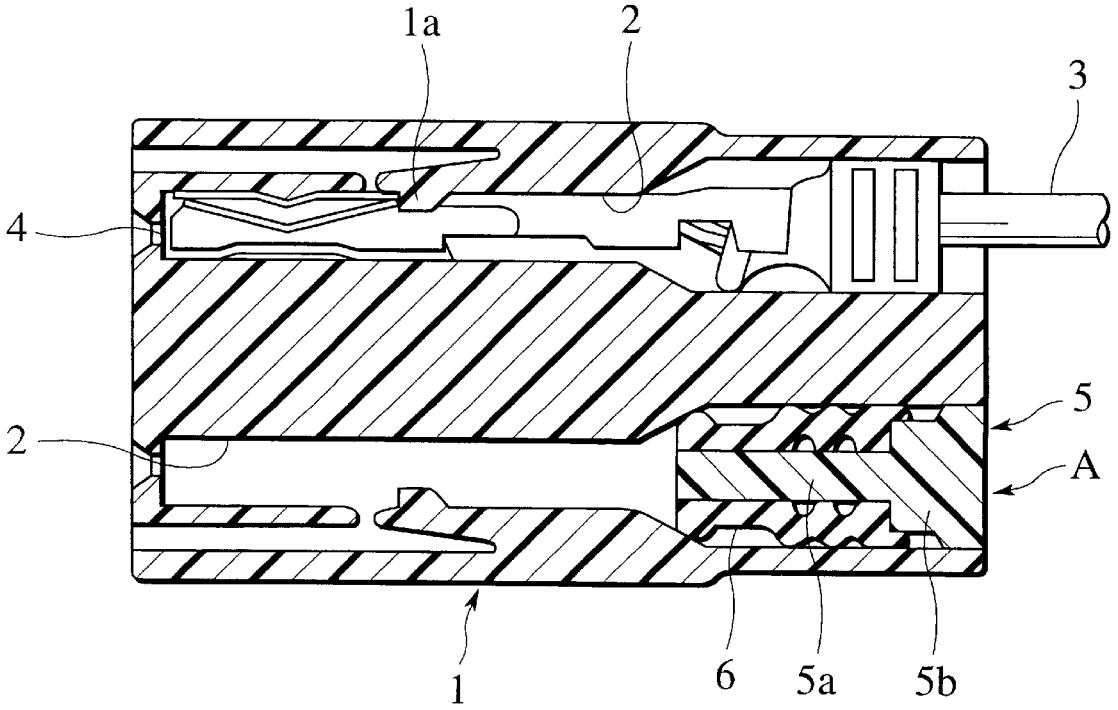
FIG.2 PRIOR ART
FIG. 2 is a sectional view of a waterproof connector using the conventional dummy tap.
Figure 3:
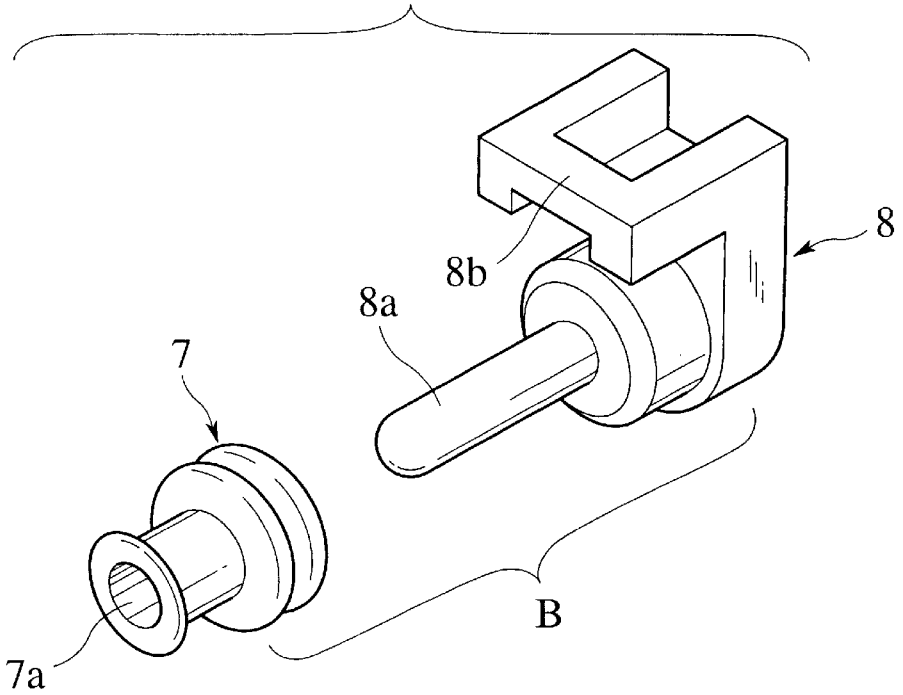
FIG.3 PRIOR ART
FIG. 3 is an exploded perspective view of another conventional dummy tap for a waterproof connector.
Figure 4:
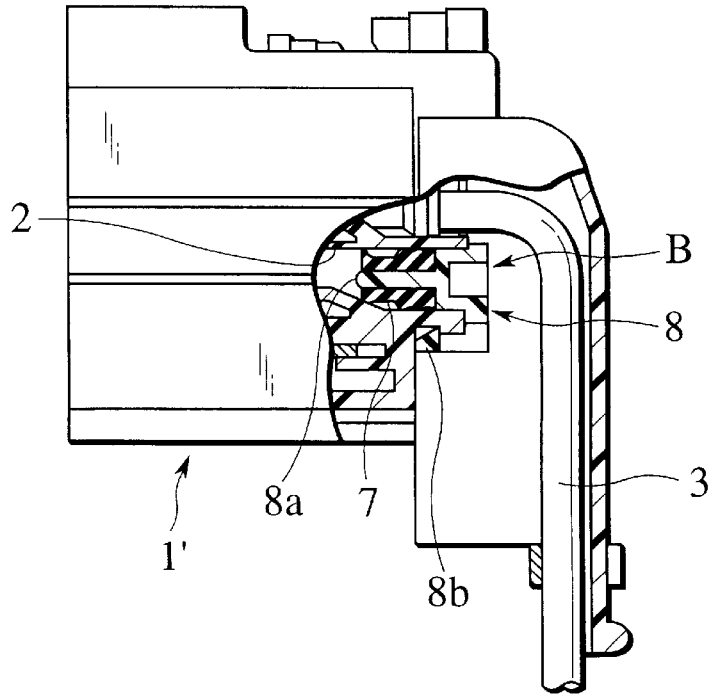
FIG.4 PRIOR ART
FIG. 4 is a side view showing a partial section of a waterproof connector using the another conventional dummy tap.

There will be detailed below the preferred embodiments of the present invention with reference to the accompanying drawings. Like members are designated by like reference characters.

Figure 5:
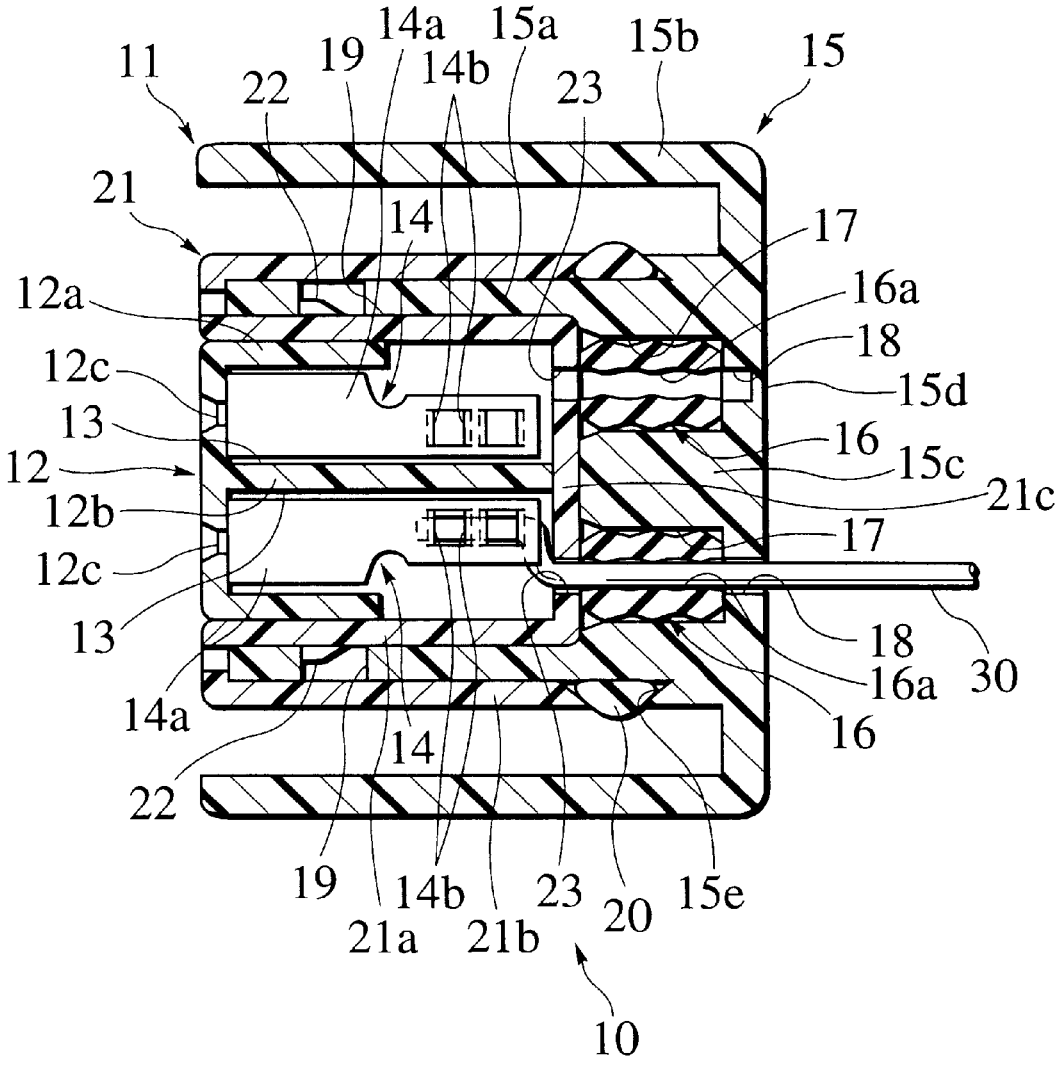
FIG. 5 is a sectional view showing a waterproof connector according to an embodiment of the present invention.
Figure 6A:
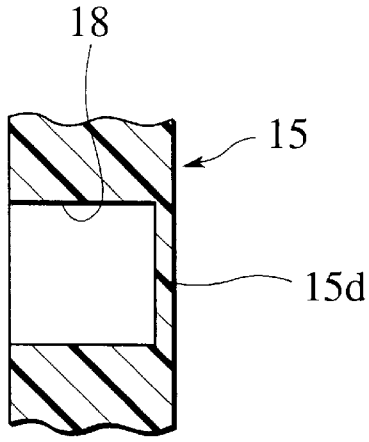
FIG. 6A is an enlarged sectional view of a thin film portion of an outer housing to be used in the waterproof connector.
Figure 6B:
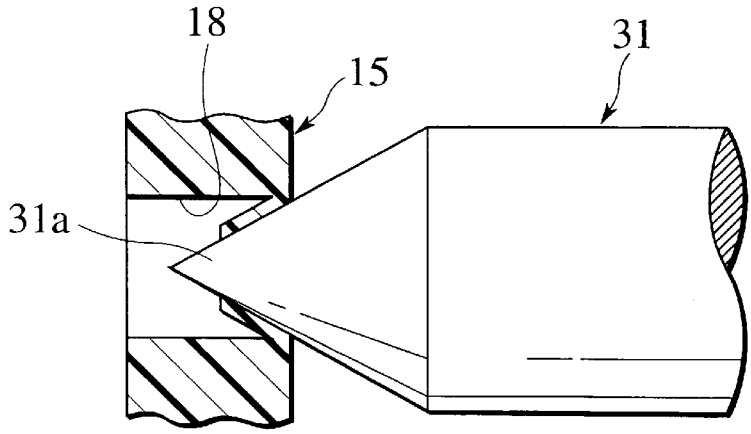
FIG. 6B is an enlarged sectional view showing a state that the thin film portion is broken through by a perforating jig or the like so that an electric wire insertion hole is formed.
Figure 6C:
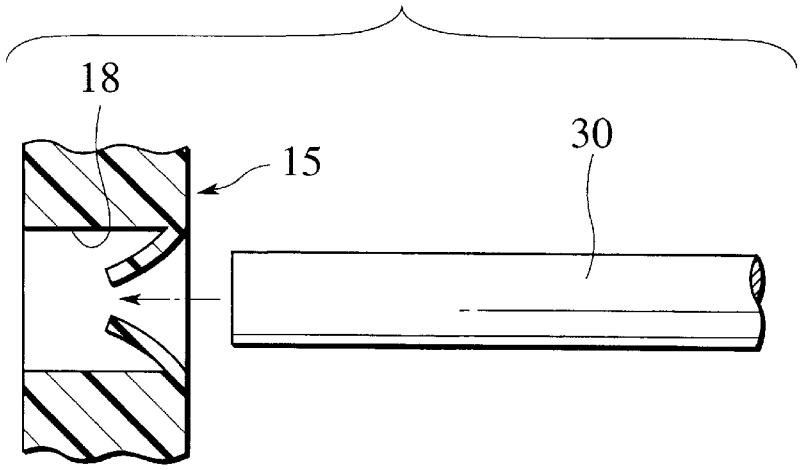
FIG. 6C is an enlarged sectional view showing a state before an electric wire is inserted through the electric wire insertion hole.

FIG. 5 is a sectional view showing a waterproof connector according to the embodiment of the present invention, FIG. 6A is an enlarged sectional view of a thin film portion of an outer housing to be used for the waterproof connector, FIG. 6B is an enlarged sectional view showing a state that the thin film portion is broken through by a perforating jig or the like so that electric wire insertion holes are formed, and FIG. 6C is an enlarged sectional view showing a state before electric wires are inserted through the electric wire insertion holes.

As shown in FIG. 5, a connector housing 11 of a waterproof connector 10 is composed of an inner housing 12 made of synthetic resin which is formed integrally with a plurality of terminal housing chambers 13, an outer housing 15 made of synthetic resin into which the inner housing 12 is fitted, and a spacer 21 made of synthetic resin which intervenes between the inner housing 12 and outer housing 15 and holds female terminals (terminals) 14 housed in respective terminal housing chambers 13 of the inner housing 12.

As shown in FIG. 5, the inner housing 12 has a box section 12*a* in which upper and lower surfaces on a backward side are opened, and the terminal housing chambers 13 are formed in spaces which are formed by a center horizontal wall 12*b* and upper and lower vertical walls, not shown, which serve also as partition walls. The female terminals 14 are housed respectively in the terminal housing chambers 13. Here, rectangular insertion holes 12*c*, through which male terminals of a mating connector, not shown, are inserted, are formed in positions of a front wall of the box section 12*a* of the inner housing 12 which face the terminal housing chambers 13. Further, a pair of pressure-welded cutting edges 14*b*, 14*b* are formed to be bent on a plate of the box section 14*a* of the female terminal 14 on the backward side.

The outer housing 15 is formed into a double box shape by a substantially square-drum-shaped inner wall section 15*a*, a substantially square-drum-shaped outer wall section 15*b* which contains the inner wall section 15*a*, and a bottom wall section (one wall section) 15*c* which connects backward portions of the inner and outer wall sections 15*a* and 15*b* so that a front side of the outer housing 15 is opened. A center of the bottom wall section 15*c* is thick, and rubber tap housing concave sections 17 with a large diameter and circular section into which waterproof rubber taps 16 are pressed are formed respectively in positions of the thick portion on the front side facing the terminal housing chambers 13. Moreover, electric wire insertion holes 18 with a small diameter and circular section through which electric wires 30 are inserted are formed on the backward side of the thick portion so as to be interconnected with the corresponding rubber tap housing concave sections 17.

As shown in FIGS. 5 and 6A, a thin film 15*d* having a predetermined thickness which blocks up the electric wire insertion holes 18 is formed by molding integrally with the outside of the electric wire insertion holes 18 in predetermined positions interconnected respectively with the rubber tap housing concave sections 17 of the outer housing 15. Namely, the thin film 15*d* is formed integrally with the outside of the plural electric wire insertion holes 18 of the outer housing 15, and only a portion of the thin film 15*d* which requires electric wire connection (wiring of the electric wires 30) is broken through by a perforating jig 31 so that the electric wire insertion holes 18 pierce there. In another way, in the case where an electric wire unnecessary portion (a portion which does not require wiring of the electric wires 30) is previously known, the thin film 15*d* may be formed integrally only with, the outside of the electric wire insertion hole 18 of the outer housing on this portion.

In addition, rectangular engagement holes (engagement sections) 19, where engagement claws, not shown, on upper and lower surfaces of the box section 12*a* of the inner housing 12 are engaged/disengaged with/from are formed respectively at the centers of the upper and lower walls on the front side of the inner wall section 15*a* of the outer housing 15. Further, V-shaped packing receiving sections 15*e* which receive a circular waterproof packing 20 made of rubber are projected respectively from inward portions of the inner wall section 15*a* of the outer housing 15. Here, as shown in FIG. 5, the waterproof rubber tap 16 has an electric wire insertion hole 16*a* whose inner and outer peripheral surfaces have an uneven substantially cylindrical shape and through which the electric wire 30 is inserted without a gap.

As shown in FIG. 5, the spacer 21 is formed into a box shape by a substantially square-drum-shaped body section 21*a* which is fitted into an inner side of the inner wall section 15*a* of the outer housing 15, a substantially square-drum-shaped collar section 21*b* which is formed integrally with a front end of the body section 21*a* so as to be bent backward and which is fitted into an outer side of the inner wall section 15*a* of the outer housing 15, and a bottom wall section (one wall section) 21*c* of the body section 21*a* so that a front side of the spacer 21 is opened.

The box section 12*a* of the inner housing 12 is fitted into the inner portion of the body section 21*a* of the spacer 21. Rib-shaped projections, not shown, for preventing the terminals from slipping off, which are engaged with backward ends of the box sections 12*a* of the inner housing 12 and backward ends of the box sections 14*a* of the female terminals 14 housed respectively in the terminal housing chambers 13, are projected integrally from the inner surfaces of the upper and lower walls of the body section 21*a* of the spacer 21. Moreover, engagement claws (engagement sections) 22 which are engaged/disengaged with/from the engagement holes 19 of the outer housing 19 are projected integrally from the outer surfaces of the upper and lower walls of the body section 21*a* of the spacer 21. Further, a forward end of the collar section 21*b* of the spacer 21 holds the packings 20 which are engaged with the packing receiving sections 15*e* of the inner wall sections 15*a* of the outer housing 15 when fitting of the spacer 21 into the outer housing 15 is completed.

In addition, electric wire insertion holes 23 are formed respectively in positions of the bottom wall section 21*c* of the spacer 21 facing the respective electric wire insertion holes 18 of the outer housing 15. Further, the bottom wall section 21*c* of the spacer 21 holds the rubber taps 16 which are inserted respectively into the rubber tap housing concave sections 17 of the bottom wall section 15*c* of the outer housing 15 so as to be capable of preventing the rubber taps 16 from slipping off when the fitting of the spacer 21 into the outer housing 15 is completed. Then, as shown in FIG. 1, the electric wires 30, which are inserted through the electric wire insertion holes 18 of the outer housing 15, the electric wire insertion holes 16*a* of the rubber taps 16 and the electric wire insertion holes 23 of the spacer 21, are connected and pressure-welded between the pair of the pressure-welded cutting edges 14*b*, 14*b* of the female terminals 14 housed respectively in the terminal housing chambers 13 of the inner housing 12 so that the terminal housing chambers 13 and electric wires 30 are sealed by the rubber taps 16 and packings 20.

In the case where the waterproof connector 10 of the present embodiment is assembled, at first the rubber taps 16 are inserted to be set into the rubber tap housing concave sections 17 in the bottom wall section 15*c* of the outer housing 15 composing the outer side of the connector housing 11 from a connector housing inserting direction, and the packings 20 are inserted to be set into the packing receiving sections 15*e* of the inner wall section 15*a* of the outer housing 15. Thereafter, the body section 21*a* of the spacer 21 is fitted into the inner wall section 15*a* of the outer housing 15, and the engagement claws 22 of the body section 21*a* of the spacer 21 are engaged respectively with the engagement holes 19 of the inner wall section 15*a* of the outer housing 15. Since the engagement holes 19 of the inner wall section 15*a* of the outer housing 15 are engaged with the engagement claws 22 of the body section 21*a* of the spacer 21, removal of the rubber taps 16 is prevented by the bottom wall section 15*c* of the outer housing 15, and thus slipping off is prevented securely. Moreover, removal of the packings 20 is prevented by a slanted forward end of the collar section 21*b* of the spacer 21, and thus waterproofness of the whole connector housing is further improved.

Next, the rubber taps 16 are inserted through the electric wire insertion holes 18 of the bottom wall section 15*c* of the outer housing 15 from the outside, and the electric wires 30 are inserted through the electric wire insertion holes 16*a* and 23 of the bottom wall section 21*c* of the spacer 21 from the outside. The electric wires 30 are pressure-welded to and connected with the pair of the pressure-welded cutting edges 14*b*, 14*b* of the female terminals 14 housed respectively in the terminal housing chambers 13 of the inner housing 12 composing the inside of the connector housing 11. Next, the inner housing 12 is fitted into the body section 21*a* of the spacer 21, and the engagement claws, not shown, of the box section 12*a* of the inner housing 12 are engaged respectively with the engagement holes 19 of the inner wall section 15*a* of the outer housing 15 so that the assembly of the waterproof connector 10 is completed.

At this time, because of diversification of variation of application or the like of the waterproof connector 10 and because of common use of variation of a wire harness circuit, the wiring of the electric wires 30 is not required on some portions. However, since the female terminals 14 are previously housed respectively in the terminal housing chambers 13 of the inner housing 12 and the rubber taps 16 are previously inserted respectively into the rubber tap housing concave sections 17 of the outer housing 15, there is some fear that water penetrates the electric wire insertion holes 16*a* of the rubber tap 16 where the electric wire 30 is not wired. However, as shown in FIGS. 5 and 6A, since the outside of the electric wire insertion holes 18 in the predetermined position of the outer housing 15 where the electric wire 30 is not required is blocked up by the thin film 15*d*, the thin film 15*d* securely prevents water from penetrating from the outside, and thus even if the electric wire 30 is not wired in the electric wire insertion hole 16*a* of the rubber tap 16, waterproofness can be obtained securely.

In addition, even if wiring paths of the electric wires 30 are changed in the connector housing 11 (for example, the electric wire 30 is wired in a portion where wiring of the electric wire 30 is not required), as shown in FIG. 6B, the thin film 15*d* which blocks up the outside of the electric wire insertion hole 18 of the outer housing 15 of the connector housing 11 is broken through by a point 31*a* of the perforating jig 31 so that the electric wire insertion hole 18 can be formed. As shown in FIG. 6C, the electric wire 30 can be inserted therethrough easily without replacing parts, and the diversification of the application or the like of the waterproof connector 10 can be further improved.

In such a manner, since the outside of the electric wire insertion hole 18 of the outer housing 15 where the electric wire is not required is blocked up by the thin film 15*d* which is formed integrally with the bottom wall section 15*c* of the outer housing 15, a dummy tap which was used conventionally is not required, and thus a number of parts can be reduced and the cost can be lowered further. Particularly, since the conventional dummy tap is not required, the normal rubber tap 16 can be used and thus additional expense of metal mold and parts managing expenses are not necessary. From this point, the costs can be lowered. Moreover, since the spacer 21 which intervenes between the inner housing 12 and outer housing 15 holds the rubber taps 16, the slipping of the rubber taps 16 can be prevented securely, and reliability of the waterproofness can be further improved.

Figure 7:
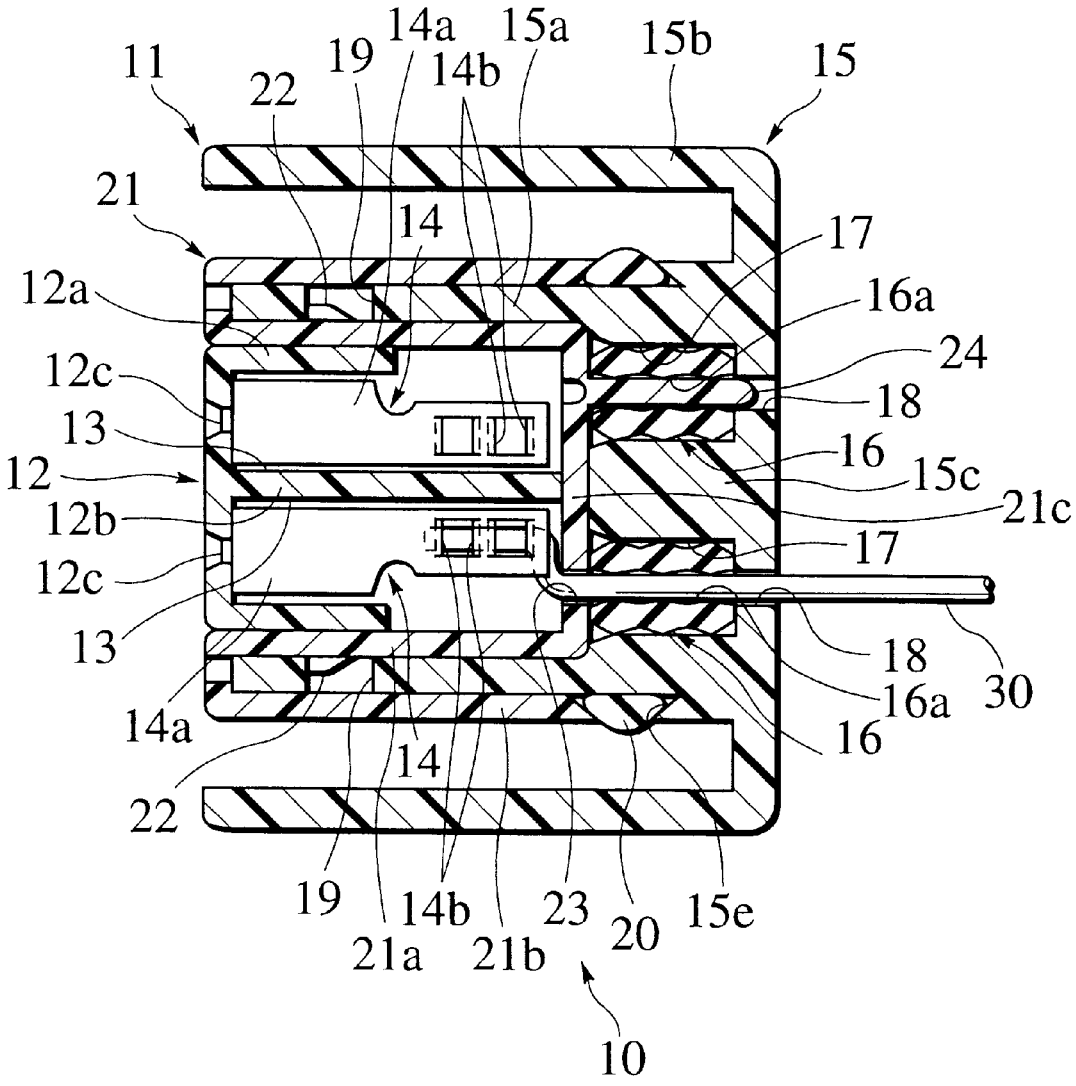
FIG. 7 is a sectional view showing the waterproof connector according to another embodiment of the present invention.
Figure 8:
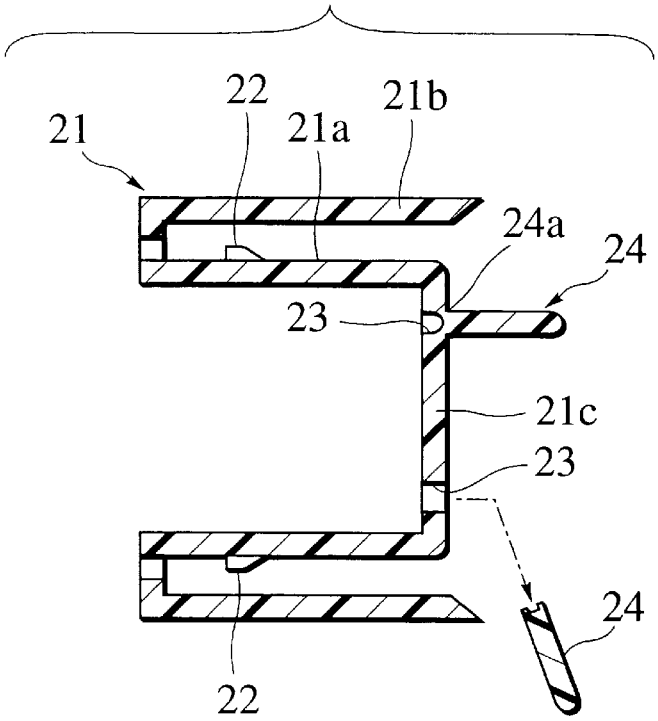
FIG. 8 is a sectional view showing another form of a spacer to be used for the waterproof connector according to the another embodiment.
Figure 9:
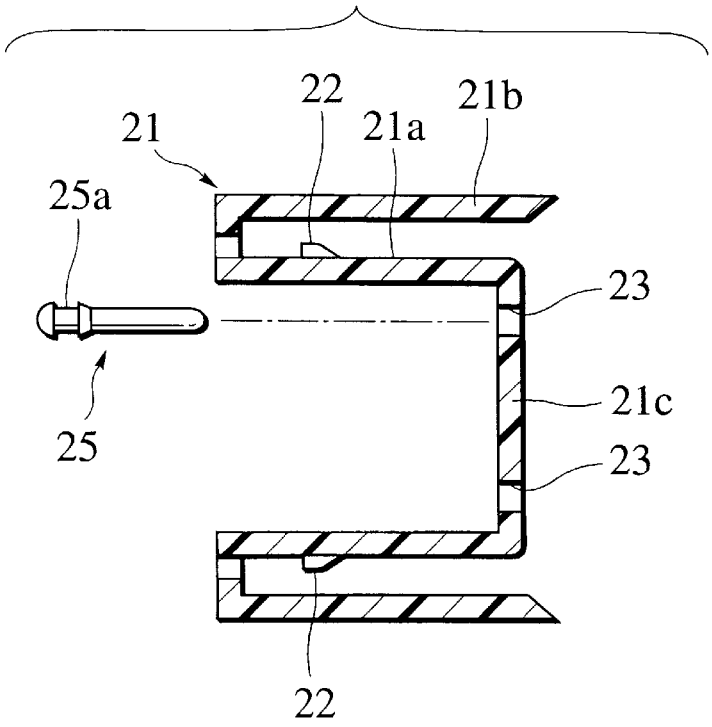
FIG. 9 is a sectional view showing another form of the spacer to be used for the waterproof connector according to the another embodiment.

FIG. 7 is a sectional view showing a waterproof connector 10' according to another embodiment of the present invention, FIG. 8 is a sectional view showing another form of a spacer to be used for the waterproof connector 10', and FIG. 9 is a sectional view showing another form of the spacer.

As shown in FIG. 7, the connector housing 11 of the waterproof connector 10' is composed of the inner housing 12 made of synthetic resin with which a plurality of terminal housing chambers 13 are formed integrally, the outer housing 15 made of synthetic resin into which the inner housing 12 is fitted, and the spacer 21 made of synthetic resin which intervenes between the inner housing 12 and outer housing 15 and holds the female terminals (terminals) 14 housed respectively in the terminal housing chambers 13 of the inner housing 12.

Here, a pin-shaped shaft 24 whose diameter is equivalent to the diameter of the electric wires 30 is projected integrally from a position of the bottom wall section (one wall section) 21*c* of the spacer 21 facing the electric wire insertion hole 18 of the outer housing where wiring of the electric wires 30 is not required. The shaft 24 of the spacer 21 is fitted into the electric wire insertion hole 16*a* of the rubber tap 16 through which the electric wire 30 is not inserted, namely, where the wiring of the electric wire 30 is not required. Since the other structure is similar to the structure of the waterproof connector 10 in the aforementioned embodiment, the same reference numerals are given to the same portions and the description thereof is omitted.

According to the waterproof connector 10' having the above structure, since the electric wire insertion hole 16*a* of the rubber tap 16 where the electric wire 30 is not wired is securely blocked up by the shaft 24 of the spacer 21 which also prevents the rubber tap 16 from slipping off, the waterproofness of the rubber tap 16 can be obtained securely. As a result, the conventional dummy tap is not required, and thus a number of parts is reduced and the costs can be lowered.

In addition, in another embodiment shown in FIG. 8, the shaft 24 of the spacer 21 is projected integrally from a position to be the electric wire insertion hole 23 of the bottom wall section (one wall section) 21*c* of the spacer 21 (a portion whose inner surface is recessed into a concave shape), and a base end 24*a* of the shaft 24 is cut by predetermined means, and the electric wire insertion hole 23 is formed in the bottom wall section 21*c*. As a result, even if the wiring paths of the electric wires 30 are changed (for example, the electric wire 30 is wired on the portion where the wiring of the electric wire 30 is not required), the base end 24*a* of the shaft 24 of the spacer 21 is cut so that the electric wire insertion hole 23 of the spacer 21 can be formed easily without replacing parts in like a conventional manner, and thus diversification of the application or the like of the waterproof connector 10' can be further improved.

Furthermore, in another embodiment shown in FIG. 9, when a stepped base portion 25*a* of a pin 25 made of synthetic resin, which is separately formed so as to have an equivalent diameter to the diameter of the electric wire 30, is fitted into the electric wire insertion hole 23 of the spacer 21 where the electric wire 30 is not wired so that a portion corresponding to the shaft 24 is projected, a shaft 25 which block up the electric wire insertion hole 16*a* of the rubber tap 16 where the electric wire 30 is not wired can be projected from the spacer 21 easily. As a result, even if the wiring paths of the electric wires 30 are changed in the connector housing 11 (for example, the electric wire 30 is wired on a portion where wring of the electric wire 30 is not required), a position of the shaft 25 of the spacer 21 can be changed easily, and thus the diversification of the application or the like of the waterproof connector 10' can be further improved.

The above embodiments described the case where the electric wire is pressure-welded to and is connected with the pressure-welded terminal, but the terminal is not limited to the pressure-welded terminal, so needless to say, the above embodiments can be applied to a case where the electric wire contact-bonds and is connected with a contact-bonding terminal.

The entire contents of Japanese Patent Application P10-162570 (filed Jun. 10, 1998) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A waterproof connector, comprising:

an inner housing defining a plurality of terminal housing chambers, the terminal housing chambers being configured to be inserted with a terminal which is connected with an electric wire;

an outer housing being configured to be engaged with the inner housing, the outer housing defining a plurality of electric wire insertion through holes configured to be inserted with the electric wire at one wall section opposing the terminal housing chambers, the outer housing further being formed with rubber tap housing concave sections at positions of the inside of the one wall section facing the former electric wire insertion through holes, the rubber tap housing concave sections being configured to be inserted with rubber taps which define other electric wire insertion through holes; and a spacer intervening between the inner housing and the outer housing, the spacer defining still other electric wire insertion through holes at positions opposing the wire insertion through holes of the outer housing;

wherein the inner housing, the outer housing and the spacer form a connector housing;

wherein the rubber taps are housed respectively in the rubber tap housing concave sections;

wherein a thin film which blocks at least one of the electric wire insertion through holes is formed integrally with a predetermined position of the outside of the at least one electric wire insertion through hole of the plurality of electric wire insertion through holes of the outer housing, the thin film being provided so as to be capable of being broken through;

wherein when the electric wire is to be connected with a terminal housed in one of the terminal housing chambers of the inner housing, the thin film is broken through, thereby the electric wire insertion through hole defined by the spacer, the electric wire insertion through hole defined by the rubber tap and the electric wire insertion through hole defined by the outer housing are interconnected so that the electric wire can be inserted through the respective electric wire insertion through hole; and wherein the rubber taps are held by the spacer such that they are prevented from slipping out of the rubber tap housing concave sections, and the rubber taps seal the terminal housing chambers and the electric wires.

2. A waterproof connector, comprising:

an inner housing defining a plurality of terminal housing chambers, the terminal housing chambers being configured to be inserted with a terminal which is connected with an electric wire;

an outer housing being configured to be engaged with the inner housing, the outer housing defining a plurality of electric wire insertion through holes configured to be inserted with the electric wire at one wall section opposing the terminal housing chambers, the outer housing further being formed with rubber tap housing concave sections at positions of the inside of the one wall section facing the former electric wire insertion through holes, the rubber tap housing concave sections being configured to be inserted with rubber taps which define other electric wire insertion through holes; and a spacer intervening between the inner housing and the outer housing, the spacer defining still other electric wire insertion through holes at positions opposing the electric wire insertion through holes of the outer housing, wherein the inner housing, the outer housing, and the spacer form a connector housing;

wherein the rubber taps are housed respectively in the rubber tap housing concave section;

wherein the rubber taps are held by the spacer such that they are prevented from slipping out of the rubber tap housing concave sections, and the rubber taps seal the terminal housing chambers and the electric wires;

wherein one of the electric wires which is inserted through the electric wire insertion through holes among the plurality of electric wire insertion through holes defined by the outer housing, is also inserted through the one of the electric wire insertion through holes formed in the rubber tap and the electric wire insertion through holes defined by the spacer so as to be connected with one of the terminals housed in the terminal housing chamber defined by the inner housing;

wherein at least one of the electric wire insertion through holes through which an electric wire is not to be inserted among the plurality of electric wire insertion through holes defined by the spacer is provided with a pin-shaped shaft having an equivalent diameter to a diameter of the electric wire in such a manner that the shaft is projected from the electric wire insertion through hole; and wherein the shaft provided on the spacer is fitted into the electric wire insertion through hole of the rubber tap which is housed in the rubber tap housing concave section facing the electric wire insertion through hole defined by the spacer through which the electric wire is not to be inserted.

3. A waterproof connector according to claim 2, wherein the shaft provided on the spacer is formed integrally at a position of the spacer where the electric wire insertion through hole is formed; and wherein when the electric wire is going to be inserted through the spacer, a base end of the shaft is cut so that an electric wire insertion through hole is formed in the spacer.

4. A waterproof connector according to claim 2, wherein the shaft provided on the spacer is capable of being fitted into and removed from the electric wire insertion through hole of the spacer.

* * * * *